US010502471B2

(12) United States Patent
Field et al.

(10) Patent No.: US 10,502,471 B2
(45) **Date of Patent: *Dec. 10, 2019**

(54) GENERATION OF HIGH ALBEDO COMPOSITE ICE

(71) Applicants: Leslie A Field, Portola Valley, CA (US); Susan J Strehlow, Portola Valley, CA (US); Dave G Duff, Portola Valley, CA (US); Kimberly M Wiefling, Redwood City, CA (US)

(72) Inventors: Leslie A Field, Portola Valley, CA (US); Susan J Strehlow, Portola Valley, CA (US); Dave G Duff, Portola Valley, CA (US); Kimberly M Wiefling, Redwood City, CA (US)

( * ) Notice: Subject to any disclaimer, the term of this patent is extended or adjusted under 35 U.S.C. 154(b) by 84 days.

This patent is subject to a terminal disclaimer.

(21) Appl. No.: 15/892,434

(22) Filed: Feb. 9, 2018

(65) Prior Publication Data

US 2018/0164012 A1 Jun. 14, 2018

Related U.S. Application Data

(62) Division of application No. 14/259,114, filed on Apr. 22, 2014, now Pat. No. 9,927,162.

(60) Provisional application No. 61/814,811, filed on Apr. 22, 2013, provisional application No. 61/832,295, filed on Jun. 7, 2013, provisional application No. 61/856,852, filed on Jul. 22, 2013, provisional application No. 61/885,010, filed on Oct. 1, 2013, provisional application No. 61/888,509, filed on Oct. 9, 2013, provisional application No. 61/903,923, filed on Dec. 13, 2013.

(51) Int. Cl.
*F25C 1/00* (2006.01)

(52) U.S. Cl.
CPC ..... *F25C 1/00* (2013.01)

(58) Field of Classification Search
CPC ..... F25C 1/00; F25C 1/04
USPC ..... 62/67
See application file for complete search history.

(56) References Cited

U.S. PATENT DOCUMENTS 5,938,991 A * 8/1999 Pollock ..... A63C 19/00 264/132
2008/0034761 A1* 2/2008 Hartley ..... C02F 1/68 62/67

* cited by examiner

*Primary Examiner* — Ana M Vazquez
(74) *Attorney, Agent, or Firm* — Shalini Venkatesh

(57) ABSTRACT

A method for generating composite ice includes forming a first layer of ice, depositing a layer of a material that includes hollow particles on a surface of the first layer of ice, and forming a second layer of ice overlying the first layer of ice to create the composite ice. The composite ice, having light scattering centers created by the presence of the deposited material, has an albedo greater than 0.15.

7 Claims, 4 Drawing Sheets

GENERATION OF HIGH ALBEDO COMPOSITE ICE

CROSS REFERENCES TO RELATED APPLICATIONS

This application is a divisional application of U.S. patent application Ser. No. 14/259,114, filed on Apr. 22, 2014, which claims priority from U.S. Provisional Patent Application Ser. No. 61/814,811, filed on Apr. 22, 2013, U.S. Provisional Patent Application Ser. No. 61/832,295, filed on Jun. 7, 2013, U.S. Provisional Patent Application Ser. No. 61/856,852, filed on Jul. 22, 2013, U.S. Provisional Patent Application Ser. No. 61/885,010, filed on Oct. 1, 2013, U.S. Provisional Patent Application Ser. No. 61/888,509, filed on Oct. 9, 2013 and U.S. Provisional Patent Application Ser. No. 61/903,923, filed on Dec. 13, 2013, all seven of which above noted applications are hereby incorporated by reference as if set forth in full in this application for all purposes.

BACKGROUND

The deleterious effects of global climate change, increasing the earth's average temperature, are increasingly obvious. These effects, which are likely to increase in magnitude over the foreseeable future, include an increase in sea level, a reduction in the percentage of the earth's surface covered by the polar ice caps, changes in rainfall distribution, increases in the severity of storms, and changes to oceanic currents. Diverse and profound changes in the distribution of habitable land areas for various species, as well as in the distribution of areas suited to agriculture, and changes in locations of usable coastal ports and shipping routes may well follow. Even if the production of greenhouse gases were to be sharply curtailed in the near future, the effects due simply to the already significantly reduced area of the polar ice caps are likely to be serious, and efforts to preserve, protect or even rebuild the ice at those locations are highly desirable.

A positive feedback loop known as the Ice-Albedo Feedback Effect is involved in the reduction of icecap area, whereby the more the ice melts, the faster the remaining ice melts. This occurs because for a given area, the open ocean absorbs more solar energy (has a lower albedo) than does ice. Moreover, newly formed ice, formed over the course of a single winter, typically is less reflective (has a lower albedo) than ice that has remained frozen through one or more years. Because of global warming, more of the increasingly scarce multi-year (high albedo) ice melts each summer, and even though substantial first-year ice is generally formed in the following winter, the overall change over the past 3 decades has been a continued drop in the effective overall albedo of the polar icecap.

It is therefore desirable to provide ice of high albedo to the regions of interest, breaking the positive Ice-Albedo feedback loop and helping to restore the polar icecaps to the point that they can increasingly resume their function as the earth's "natural refrigerator".

It may also be desirable to provide ice with modified thermal properties, that may be independent of albedo, but that nevertheless serve to encourage the formation or persistence of other ice in the vicinity of the provided ice, and thus indirectly contribute to the goal of increasing the effective albedo of the local region.

SUMMARY

The present invention includes a method for generating ice. In one embodiment, a material is introduced to water, and the temperature of the combination of the water and the material is lowered until ice forms, the formed ice overall having a higher albedo than it would have had if the step of lowering the temperature had been carried out on the water without first carrying out the step of introducing the material. In one embodiment, the material is selected such that an aqueous solution of the material is alkaline.

In one embodiment, a material is introduced to water, and the temperature of the combination of the water and the material is lowered until ice forms, the ice forming at a faster rate than the rate at which it would have formed if the material had not been introduced to the water. In another embodiment, the ice forms at a higher temperature than the temperature at which it would have formed if the material had not been introduced to the water.

DETAILED DESCRIPTION

The manner in which the present invention provides its advantages can be more easily understood with reference to FIGS. 1 through 4.

Figure 1:
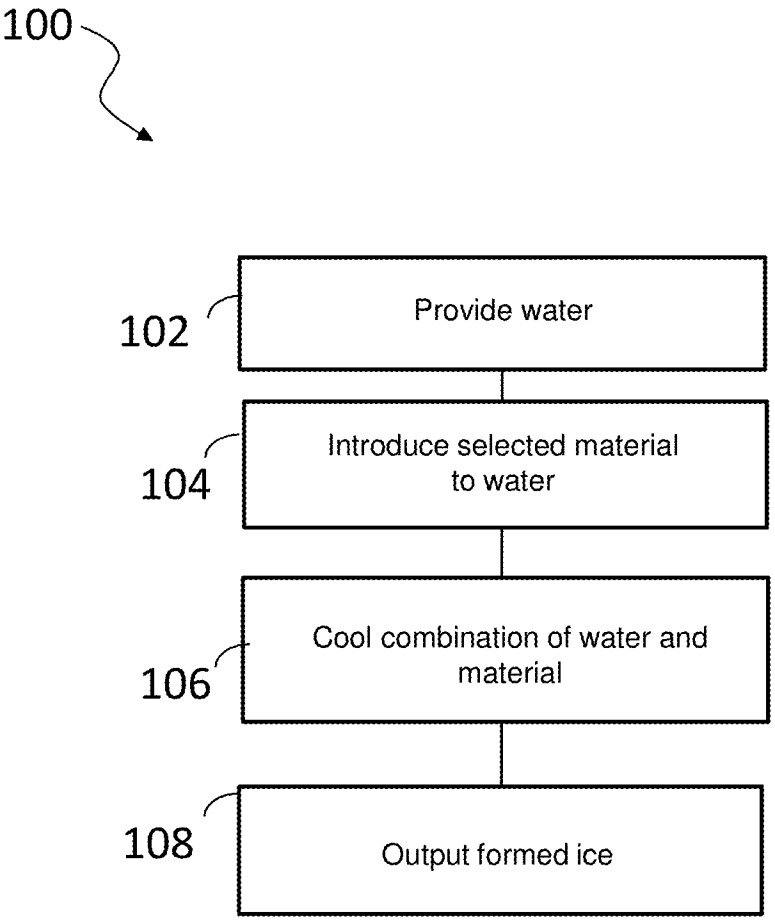
FIG. 1 is a flowchart illustrating the steps of a method for generating ice according to one embodiment.

FIG. 1 is a flowchart illustrating the basic steps of a method 100 for generating ice according to one embodiment of the invention. In this embodiment, at step 102, an input of water is provided. In some cases, the water may be one component of a liquid mixture or solution. In some other cases, the input may simply be pure water. At step 104, a selected material is provided and introduced to the water. At step 106, the temperature of the combination of water and the introduced material is lowered at least to the point at which ice is formed. This cooling may be carried out using a refrigeration system of some kind, as will be discussed in connection with FIG. 2, or by taking intelligent advantage of local environmental conditions, such as the difference between the temperature of the air above a large body of water and the temperature of the water within that body, and using thermal isolation techniques such as will also be described below. At step 108, the formed ice is deployed at the desired location, which may, for example, be the top surface of a body of water, or of a pre-existing body of ice, or of ground with partial or full snow cover, or even of bare ground.

In some embodiments, the material introduced at step 102 is selected such that the formed ice has a higher albedo than it would have had if the step of lowering the temperature had been carried out on the water without carrying out the step of introducing the material, which may be introduced in granular, powdered or crystalline form, or dissolved or suspended in a liquid, or even as a larger piece of solid material.

It should be noted that the albedo will typically vary over the surface of formed ice, being higher in some locations than others. For convenience, the term "albedo" is used throughout this specification without further qualification, but it should be understood to mean an average value representative of the overall top surface of the piece of ice of interest.

The effect of increasing the albedo of the formed ice may be achieved in some cases by virtue of the optical properties of the material. In some cases, the albedo may be increased by virtue of a chemical interaction between the material and the water. The interaction could, for example, form bubbles that subsequently act as light scattering centers in the formed ice. Such bubbles may also be formed by physical rather than chemical interactions, for example when the material is introduced in the form of granules or a crystalline or amorphous powder and stirring or other mixing operations are performed. In some cases, the particles of the added material may simply act as nucleation sites for the generation of bubbles of gas previously dissolved in the water.

The albedo increase may occur because the crystalline structure of the ice is disrupted directly by the presence of the added material, whether in the form of suspended particles, or gas formed, nucleated or entrained, or in "pockets" containing a solution of the material in liquid or solid form. This can be thought of as akin to sub-domains in solids such as magnetic recording materials. Particles may act directly as scattering centers. Dissolved particles may result in or cause regions of changed refractive index. In either case, incident light encountering the corresponding discontinuity will be scattered, and the effective albedo increased.

The concentration and spatial distribution of the particles of the material may be chosen to optimize the albedo enhancing effect.

In some embodiments, the material introduced at step 102 is selected such that the ice forms at a faster rate than the rate at which it would have formed if the material had not been introduced to the water. This effect may be achieved in some cases by virtue of the material aiding in a nucleation process that facilitates the ice formation. When, for example, the material is introduced in the form of granules or a crystalline or amorphous powder, the particles of the material may act directly as nucleation sites for the new ice. Another possibility is that bubbles of previously dissolved gas, formed as discussed above, may act as nucleation sites for the new ice and/or that the gas itself can become frozen into the ice, such as in bubble form, which can change the optical properties of the ice.

In some embodiments, the material introduced at step 102 is selected such that the formed ice remains frozen in surroundings of higher temperature for a time longer than the time for which it would have remained frozen in those same surroundings if step 106 of lowering the temperature had been carried out on the water without first carrying out the step of introducing the material. It is speculated that this effect may be achieved in cases when the material is introduced in the form of granules or a crystalline or amorphous powder, by the particles of the material acting to trap droplets of melting ice within the bulk ice, thermally insulating the droplets from the more distant ambient.

In some cases, the thermal properties of the introduced material may cause or contribute to the increased rate of ice nucleation and/or formation. In still other cases, the materials themselves may change the properties of the water or aqueous liquid mixture to which it is introduced, so that the overall thermal properties change in a linear or nonlinear manner, changing, for example, the heat capacity of the new system of liquid-plus-added material.

In the cases discussed above where the ice forms at a faster rate with the introduction of the material than without, there may, but need not necessarily, be an accompanying increase in the albedo of the formed ice.

In some embodiments, the temperature of the liquid may be reduced more rapidly, for a given rate of removal of thermal energy, than before the added material was introduced into the system. This could be due to a corresponding change in the thermal capacity and/or thermal conductivity of the aggregate system. Lowering either or both of these parameters would reduce power requirements for creating ice and thus for cooling applications in general, as well as the specific application of providing more ice, and bright ice at that, to replenish the depleted store of multi-year-type highly reflective ice in the earth's cold regions. The rapid temperature reduction may also be due to the existence of nucleation sites preventing or reducing supercooling, which if allowed to occur would be detrimental to the efficient formation of ice. These techniques and materials could also improve the feasibility of adding or forming ice to preserve permafrost, thus preventing or reducing potentially catastrophic methane releases from its melting.

In one embodiment, the ice may form at a higher ambient temperature than the temperature at which it would have formed if the material had not been introduced to the water. It is envisaged that this effect may be achieved by virtue of a nucleation process as discussed above. In some cases the effect may be achieved by virtue of thermal properties of the material or of the combination of the material and the water. For example, the addition of the material to water may result in the formation of a layer of different thermal conductivity or thermal heat capacity than the water would have had without the introduction of the material, the difference in turn causing lower temperatures in adjacent ice or water that in turn facilitates the freezing of the material/water combination. The higher freezing temperature may also be due to the existence of nucleation sites preventing or reducing supercooling, as discussed above.

In one embodiment the material may be selected such that if and when the formed ice eventually melts or sublimes, the pH value of the resulting aqueous solution would be slightly alkaline. This could have a beneficial effect in tending to counter ocean acidification, another pressing current global environmental problem. One example of a material that could be introduced and would increase pH in this way is sodium bicarbonate, commonly known as baking soda. A 0.1 molar aqueous solution of sodium bicarbonate at 25° C. would have a pH value of approximately 8.4. This particular material would have other advantages in being readily available, in an easily dispensed form, at low cost, as well as being unlikely to cause any problems to animal or plant life in the vicinity. Another possible choice is sodium carbonate, which would provide significantly greater alkalinity at a corresponding concentration and temperature. Sodium carbonate also may be a desirable choice from the viewpoint of its lower manufacturing carbon footprint. Among many other examples of benign materials that could confer similar advantages in aqueous solution are sugar and soap. Salts of potassium, calcium and magnesium may also be considered.

In some embodiments the material introduced to the water may be gaseous, comprising bubbles of air or another gas mixture or a single gaseous element. It is well known that bubbles may directly increase the brightness of liquids, such as water, in which they are contained. Bubbles may similarly increase the brightness of ice that is generated by cooling water into which bubbles are introduced. Bubbles may change the thermal properties of such ice, in ways that encourage the formation or persistence of other ice in the vicinity, and thus contribute, as noted above, to the goal of increasing the effective albedo of the local region.

In some cases, the material may comprise a mixture of an albedo enhancing material and one or more additives conferring other beneficial properties to the subsequently formed ice. Such properties may include ease of handling, pH buffering, resistance to biofouling, ability to withstand multi-year freeze-thaw cycles (if desired), or ability to destroy or inhibit the growth of microorganisms. Alternatively, one or more such additives may be introduced separately, before, during or after the introduction of the albedo enhancing material. In some embodiments, the material may comprise a mixture that includes a chemical compound such as calcium or magnesium carbonate, which could allow carbon sequestration from the atmosphere and the ocean to be achieved. In some embodiments, the materials may be naturally occurring substances such as diatomaceous earth or pumice.

In embodiments where the material is introduced in particulate form (granules or a crystalline or amorphous powder) the size and/or shape of the particles may be configured to achieve the desired albedo increasing effect. In some cases, coatings may be applied to improve this effect, or to provide other benefits such as faster ice nucleation and/or formation, higher temperature ice nucleation and/or formation, pH adjustment, resistance to biofouling, increased ease of handling, durability, microorganism inhibition, increased wettability (hydrophilicity) etc.

In some embodiments, the material added to the ice can be in the form of hollow glass or plastic spheres, or pancakes or disks, hexagons, or other desirable shapes. The material can be selected to be ecologically benign. The material can be designed to sink or otherwise degrade over time, in some cases being biodegradable. A material selected from corn-based polymers may be particularly suitable in this regard. The material can, but need not, be floatable, as in embodiments where the material is incorporated into ice, the buoyancy of the ice itself may be sufficient to ensure flotation during the desired time of deployment. In some cases, a mixture or combination of different materials may be used, for example hollow glass spheres and baking soda, and/or non-toxic gels or gel-like substances with high water absorbance.

In some embodiments, step 106, the lowering of the temperature of the water/material combination, may be carried out in a manner that produces one or more blocks of ice of micro to macro dimensions, for example as small as tens of microns, or larger than tens of centimeters. Any of a variety of conventional refrigeration techniques may be used. In some embodiments, the temperature lowering may include a spraying or droplet formation process, where exposing the increased surface area of the droplets (relative to bulk liquid) to a cold ambient results in relatively fast cooling and freezing of the droplets. Allowing this generated artificial snow or hail to fall on the surface of pre-existing ice, snow, bare ground, or water may significantly increase the albedo of the resulting new surface. The new snow or snow-like material just formed may be particularly advantageous for use in ski areas, on glaciers and lakes to preserve drinking water, on glacial and other melt ponds, on permafrost, on snow roads, for pipeline stabilization, and the like. It may also be useful in building and insulating materials.

In some embodiments, the material is added to water; in others, water may be added to the material. For example, in one embodiment the material of interest may be distributed over the surface of some pre-existing ice, or of a body of water, or of ground adjacent to a body of ice, or to a body of water. Then water may be added on top of that material—pumped, for example, from a nearby body of water, possibly by tidal action—to mix with or overlie the material. Natural cooling may then result in the creation of a new ice layer incorporating the material, and thus having improved albedo and/or thermal properties. This may be particularly beneficial in its application to thin pre-existing ice, in effect modifying it to behave more like thick, highly reflective multi-year ice.

In some embodiments the ice formation may be carried out as a batch process; in others a continuous production line approach may be used. In some cases, production techniques developed for roll-to-roll manufacturing may be advantageously applied to efficient generation of ice blocks.

Figure 2:
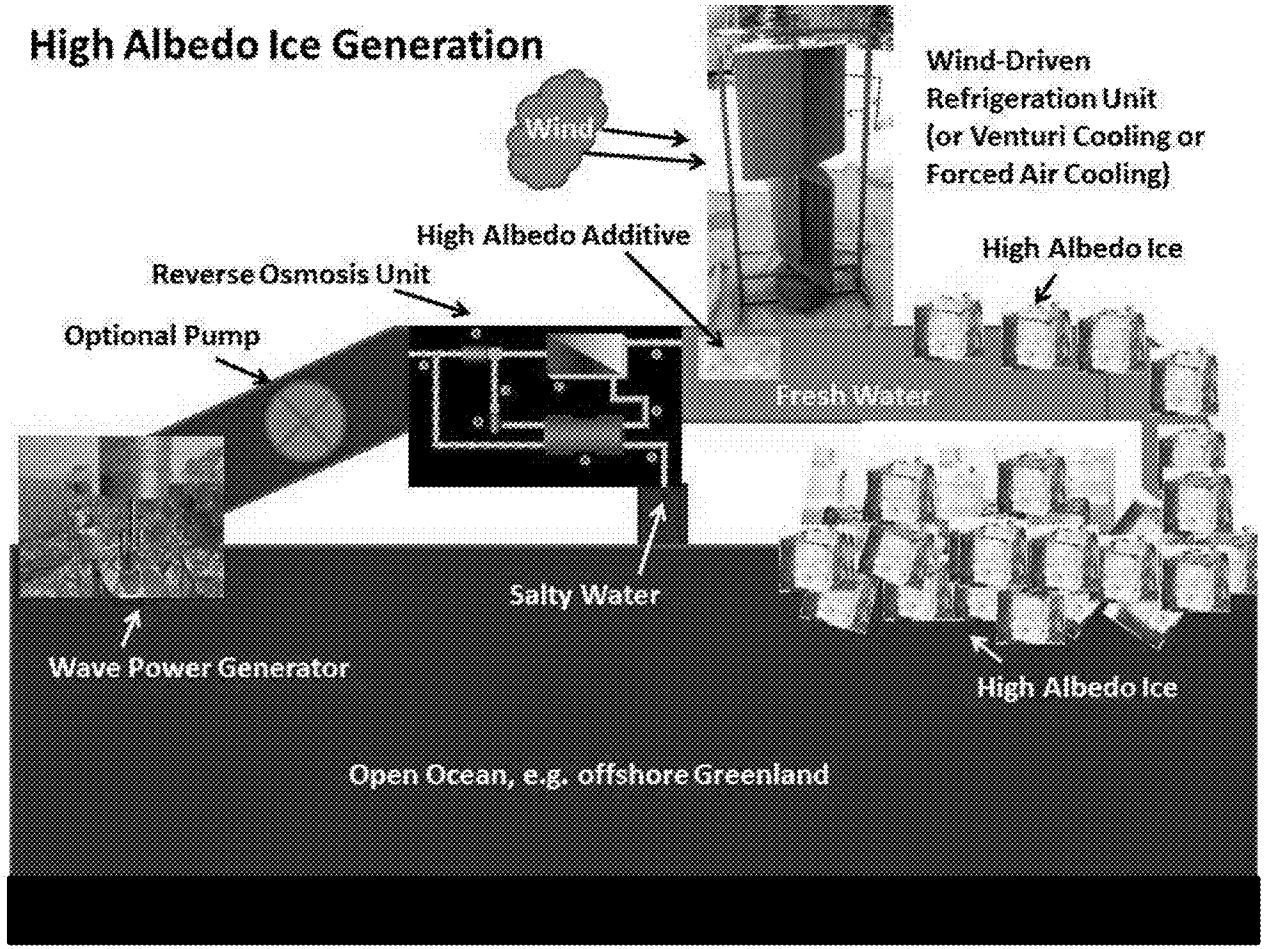
FIG. 2 illustrates an apparatus that generates ice according to one embodiment.

FIG. 2 is a pictorial representation of an apparatus for generating ice according to one embodiment. This embodiment takes advantage of a local source of the water from which the desired ice will be formed, and local renewable, energy sources for the power required to drive the various processes, including pumps to move the water, a reverse osmosis process for an initial desalinization of the water, a delivery system for the material to be added to the processed water, an optional refrigeration system to cool the combination to form the desired ice (ambient conditions may suffice), and a transport system to deliver the ice to a desired deployment location. Other embodiments may include some but not all of these elements. The renewable energy sources may be wave, wind, and/or solar, but other possibilities can easily be envisaged. Desalinization may be carried using processes other than reverse osmosis, such as solar distillation for example. While FIG. 2 illustrates a case where the material added is selected to increase the albedo of the formed ice, in other embodiments, the material may be selected to increase the rate of formation of that ice. In some embodiments, the material may have both attributes.

In some embodiments, it may be advantageous to remove and isolate a relatively small volume of water from the ocean or melt lake or other larger body of water around it, for example by confining the removed water within a thin shelf or tray arrangement, before adding the selected material to it and lowering its temperature. The water/material combination will freeze more readily in this situation, where it is not in thermal contact with the large body of water. It should be noted that in the geographical regions of interest, at some times of year, the air above such a body of water is typically much colder than the water within that body, so maximizing exposure of the combination to the air will be beneficial. When the formed piece of ice is then deployed to float on the large body of water, the cooling effect of that ice, reflecting incident sunlight and hence cooling the underlying and surrounding water, will be very much greater than if the same amount of energy used to create that ice had been applied to the larger body of water as a whole. An improvement will occur even if the ice is not of very high albedo, as its albedo will certainly be higher than the albedo of open water. In some cases the formed ice may be deployed in the form of relatively small blocks spread over existing ice, again with the goal of increasing effective albedo.

Such a "tray" arrangement may provide good isolation from underlying ground or permafrost when used in environments other than over deep water. In some cases air contact may be provided on both sides. In some cases, the tray or similar container may remain in place in the formed deployed ice, and could be biodegradable, possibly over a predetermined period of time. In some embodiments, a tray surface may be textured or otherwise designed to selectively retain the material during a desired number of thaw and re-freeze cycles.

In some cases, rather than confining the water within a tray that acts merely as the means of confinement, the tray may itself be made up, at least in part, of material of the same chemical composition as the material subsequently added thereto, becoming an integral part of the formed ice. In some cases, there may be no need to add additional material to the water before the temperature is lowered to form ice; the tray material itself serving the desired purpose of allowing the formation of ice of high albedo, ice of increased longevity, etc.

The partially isolated combination may still be adjacent or even surrounded by the larger body of water, but the effect of the material in cooling the isolated water, may be beneficially transmitted to the surrounding water by thermal processes, such as, for example, the flow of ambient air over the surface of one reaching the other. In this way, the cooling, possibly freezing, of the water/material combination may facilitate ice formation in the larger body of water.

The formation of ice in such a thermally isolated manner may be carried out to create an initial platform of ice, incorporating a first material, onto which a second layer of ice optionally containing a second material, may be deposited. In one such embodiment, the first material is added to water confined within a volume characterized by a relatively large exposed top surface, and relatively shallow sides, such that cooling efficiency is optimized. After the first layer of ice is formed, a second layer of ice containing the second material may be deposited on top. This deposition may take place after the initial layer is deployed, for example floating on the ocean surface, or prior to deployment. In either case, a highly desirable goal is that the resulting dual layer ice structure remains frozen in surroundings of higher temperature for a time longer than the time for which it would have remained frozen in those same surroundings in the absence of the first and second materials. Another desirable goal is that if and when the second layer of ice does melt, the platform may remain intact for some useful time thereafter, providing support for another layer of ice or snow to be deposited thereupon. Such new layers may be naturally formed, or formed using artificial methods including those described in this disclosure.

The considerations discussed earlier in this disclosure in the context of forming a single layer of ice, regarding surface texturing of a "container" for the water before freezing, or the possibility of incorporating the first material as part of the structure of the container, or of the container including features that selectively retain the first material, apply equally well to dual layer implementations where the formed layer of ice serves as a platform for an overlying layer incorporating the second material.

Another attractive feature of such platforms of ice is their potential use as resting grounds or temporary habitats for wildlife, including birds and mammals. Polar bears, in particular, are known to be adversely impacted by the drastically diminished areas of "solid" ground in their natural habitat. The provision of artificial supporting surfaces for such animals may be of significant ecological value.

In some embodiments, the first material may be chosen to be biodegradable. In some embodiments the second material may be chosen such that the second layer or ice has a high albedo. In some embodiments, the first material may be chosen such that the platform of ice has a high albedo, even in the absence of the second layer of ice thereupon.

In some embodiments, rather than forming one layer of ice with a first material and then a second layer of ice with a second material, a single layer of ice comprising both materials may be formed. In some cases, the formation may be carried out in a shallow tray arrangement as described above, to optimize cooling efficiency. The first material may comprise a surface comprising pores configured to attract the second material thereto and/or retain the second material therewithin. In such cases, the first material may be chosen at least in part for its structural properties while the second material may be chosen at least in part for its ability to impart high albedo and/or longevity of the frozen state to the resultant ice.

In some cases the first material may comprise a sleeve or mesh.

The approach illustrated in FIG. 2 may be very attractive in allowing the ice to be conveniently generated at or near the location of desired deployment. Alternatively, the ice may be generated elsewhere, perhaps at a location where power to drive the various processes is so much more cheaply or easily obtained that it can overcome the costs of transportation of the ice to the location of desired deployment.

Figure 3:
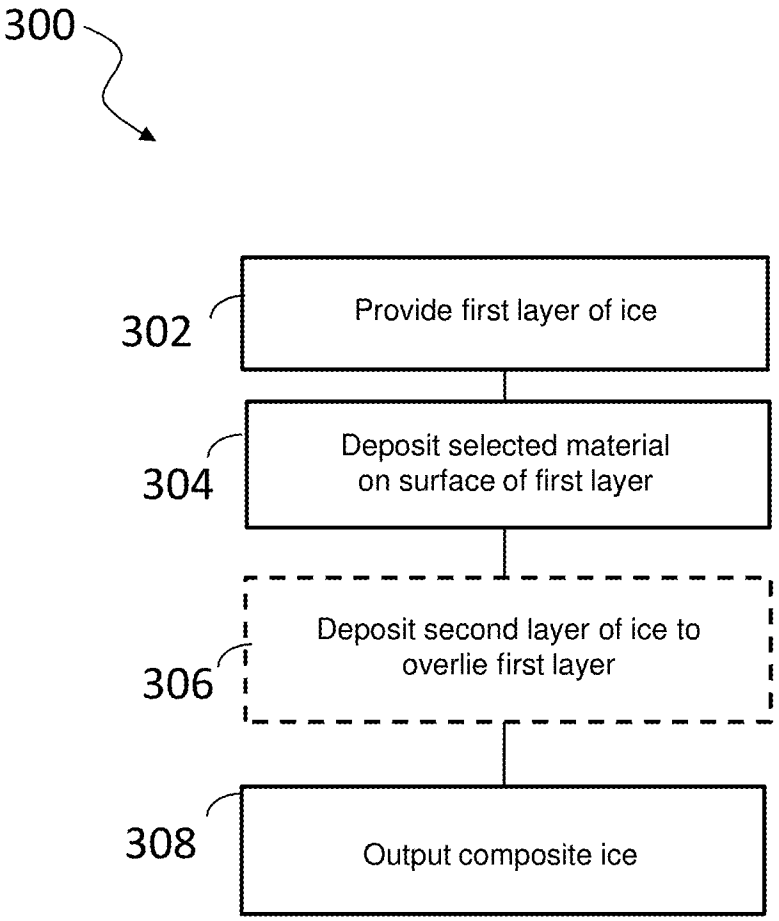
FIG. 3 is a flowchart illustrating the steps of a method for generating composite ice according to another embodiment.
Figure 4:
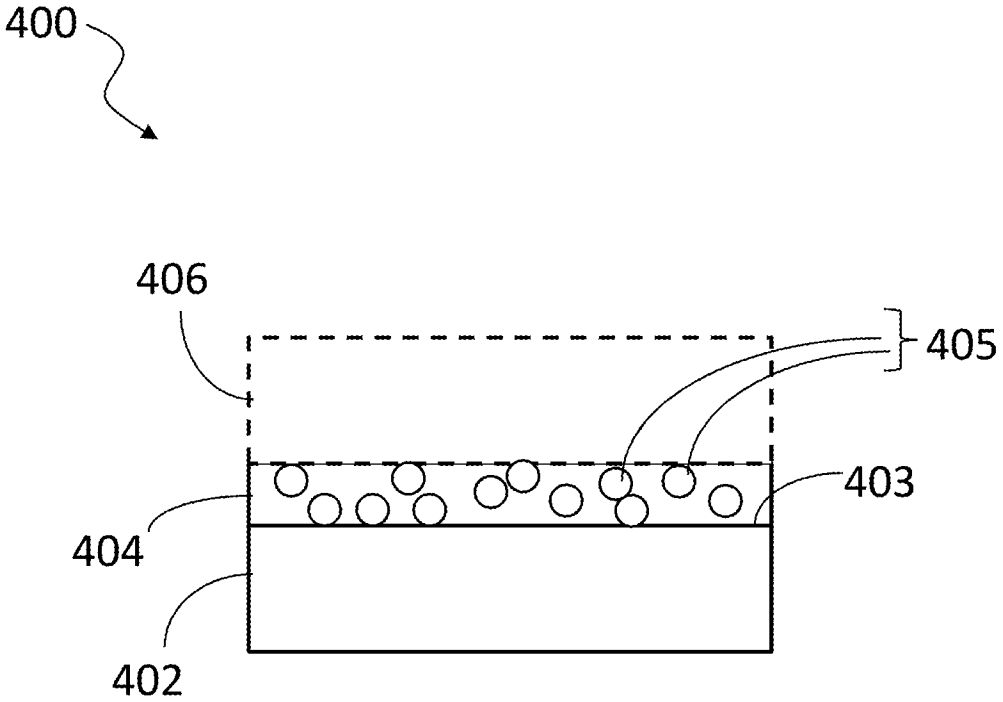
FIG. 4 is a cross sectional view of composite ice generated according to one embodiment.

FIG. 3 is a flowchart illustrating the basic steps of a method 300 for generating composite high albedo ice according to another embodiment of the invention. FIG. 4 is a cross sectional view of composite ice 400 generated according to one embodiment of method 300. In step 302 of method 300, a first layer 402 of ice is formed. At step 304, a layer 404 of material 405 is deposited on a surface 403 of the first layer 402. At optional step 306, a second layer 406 of ice is formed, overlying layers 402 and 404. Composite ice 400 has a higher albedo than it would have had if step 304, depositing layer 404 of material 405, had not been carried out.

In some cases, the deposition of layer 404 of material 405 may comprise an initial deposition of liquid water followed by the deposition of material 405 and then cooling to form ice. In cases where material 405 is deposited in particulate form, it may be randomly distributed over surface 403, as shown, or more evenly spread, in one or more layers. The thickness of layer 404, and the concentration and spatial distribution of material 405 within layer 404 may be optimized with regard to the resulting albedo enhancing effect. In some cases, the deposition of layer 404 of material 405 may comprise the deposition of liquid water in which material 405 has already been introduced. In yet other cases, the deposition of layer 404 of material 405 may comprise the deposition of a layer of ice of a desired thickness in which material 405 has already been incorporated at a desired concentration and distribution.

The various considerations discussed above with respect to method 200, regarding the optical, chemical, structural, and thermal properties of the material apply equally well to method 300. An additional consideration with method 300, in the case where step 304 is not carried out, is that layer 404 may not include water or ice at all, exposing material 405, and allowing such parameters as its areal concentration, surface morphology etc to be chosen to directly optimize albedo, nucleation rate, etc.

In some cases, the top surface of the formed (method 100) or composite (method 300) ice may act as a convenient receptive surface on which snow and ice may subsequently form naturally. In other cases, where no snow or ice forms thereon, the desired objective of increased albedo reducing the temperature of the environment in the vicinity of the formed or composite ice, thus preventing, reducing, or delaying the melting of ice in that location will nevertheless be achieved.

The methods and apparatus described herein may also be advantageous in applications other than the polar icecap protection and rebuilding application of immediate interest as described. One example is to help stabilize permafrost, with a possible side benefit of preventing release of methane (a powerful greenhouse gas). Other possibilities are in snow making, snow stabilization, and in maintaining lower temperatures in glacial melt ponds, in man-made cooling ponds such as in power plants located in cold locations, in coastal areas, and even in open oceans. Some embodiments of the present invention may be directed specifically to the goal of water cooling and conservation (via reducing a local evaporation rate), for example for agricultural and residential needs. The materials used would have to be carefully selected for appropriate levels of safety, to humans and the environment as a whole, in any and all such deployment locations.

In some embodiments, the albedo of an area may be increased to at least 0.15, to be greater than the albedo of open seawater. In some embodiments, the albedo may be increased to a level greater than the global average of the earth, or to at least 0.35. Some embodiments may include increasing the albedo to above 0.5, or further to be above 0.7, which can help to cool and preserve water.

Embodiments of the present invention thus enable the environmentally benign generation and deployment of high albedo ice to areas in which the resulting cooling of the earth's surface in the vicinity of the deployment may be highly beneficial. While the terms "ice" and "snow" are generally used to refer to distinctly different materials, it should be noted that in the context of this invention, the terminology relating to the generation of ice should be taken as including the generation of snow, which is defined as flakes of crystalline ice.

While the various embodiments described above include the addition of a material to modify the optical and/or thermal properties of ice, some embodiments may be envisaged where simply generating ice by cooling water without the addition of such materials, and then deploying that ice on the surfaces of interest—pre-existing thin ice, for example, or the water at a shoreline, adjacent to surfaces including ice or snow—would be beneficial. Many aspects discussed above in connection with the previously discussed embodiments would also be relevant to such additive-free embodiments. One example would be using local renewable energy sources to power the cooling and transport of the water and formed ice. Another would be using shallow trays for thermal isolation and faster cooling.

The above-described embodiments should be considered as examples of the present invention, rather than as limiting the scope of the invention. Various modifications of the above-described embodiments of the present invention will become apparent to those skilled in the art from the foregoing description and accompanying drawings. Accordingly, the present invention is to be limited solely by the scope of the following claims.

The invention claimed is:

1. A method for generating composite ice, the method comprising:

forming a first layer of ice;

depositing, on a surface of the first layer of ice, a layer of a material comprising hollow particles; and forming a second layer of ice overlying the first layer of ice to create the composite ice;

wherein the composite ice, comprising light scattering centers created by the hollow particles, has an albedo greater than 0.15.

2. The method of claim 1 wherein the composite ice has an albedo greater than 0.35.

3. The method of claim 1, wherein the layer of material is characterized by a layer thickness;

wherein the deposition of the layer of material comprises depositing the particles at a particle concentration and particle spatial distribution; and wherein the layer thickness, the particle concentration and the particle spatial distribution are selected to optimize the albedo of the composite ice.

4. A method for generating composite ice, the method comprising:

depositing, on a surface of liquid water, a layer of a material comprising hollow particles to form a composite mixture; and cooling the composite mixture to create the composite ice;

wherein the composite ice, comprising light scattering centers created by the hollow particles, has an albedo greater than 0.15.

5. The method of claim 4 wherein the composite ice has an albedo greater than 0.35.

6. A method for generating composite ice, the method comprising:

forming a first layer of ice;

depositing, on the first layer, liquid water into which a material comprising hollow particles has been introduced, forming a combination;

cooling the combination to create the composite ice;

wherein the composite ice, comprising light scattering centers created by the hollow particles, has an albedo greater than 0.15.

7. The method of claim 6 wherein the composite ice has an albedo greater than 0.35.

* * * * *